US008330337B2

(12) United States Patent
Yu et al.

(10) Patent No.: US 8,330,337 B2
(45) Date of Patent: Dec. 11, 2012

(54) HEAT DISSIPATION DEVICE AND LED LAMP USING THE SAME

(75) Inventors: Guang Yu, Shenzhen (CN); Qian Xiang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 80 days.

(21) Appl. No.: 12/943,013

(22) Filed: Nov. 10, 2010

(65) Prior Publication Data

US 2012/0098401 A1 Apr. 26, 2012

(30) Foreign Application Priority Data

Oct. 22, 2010 (CN) ..... 2010 1 0516269

(51) Int. Cl.
*H01J 61/52* (2006.01)
*F28D 15/04* (2006.01)

(52) U.S. Cl. ..... 313/46; 164/104.26

(58) Field of Classification Search ..... 362/294
See application file for complete search history.

(56) References Cited

U.S. PATENT DOCUMENTS

| | | | | |
|---|---|---|---|---|
| 7,611,263 | B2 * | 11/2009 | Huang et al. | 362/249.02 |
| 2003/0210526 | A1 * | 11/2003 | Huang et al. | 361/697 |
| 2011/0100610 | A1 * | 5/2011 | Chao et al. | 165/104.26 |
| 2011/0120668 | A1 * | 5/2011 | Li et al. | 165/67 |
| 2011/0265976 | A1 * | 11/2011 | Li et al. | 165/104.26 |

* cited by examiner

*Primary Examiner* — Tracie Y Green
(74) *Attorney, Agent, or Firm* — Altis Law Group, Inc.

(57) ABSTRACT

An LED lamp includes a light source including LEDs and a heat dissipation device. The heat dissipation device includes a heat absorption board contacting the light source to absorb heat generated by the LEDs, a fin assembly located over the heat absorption board, two heat pipes thermally connecting the heat absorption board and the fin assembly, a fan and a fan holder fixing the fan on the fin assembly. The fan holder includes a supporting board supporting the fan and supporting posts connecting an outer edge of the heat dissipation board and an outer edge of the supporting board. The supporting posts are embedded in the fin assembly.

12 Claims, 5 Drawing Sheets

HEAT DISSIPATION DEVICE AND LED LAMP USING THE SAME

BACKGROUND

1. Technical Field

The disclosure generally relates to a heat dissipation device and an LED lamp using the heat dissipation device, and more particularly to a heat dissipation device with a fan holder and an LED lamp using the same.

2. Description of Related Art

A heat dissipation device includes a heat sink for dissipating heat generated by a heat-generating component, a fan mounted on a top of the heat sink, and a fan holder fixing the fan on the heat sink. The fan holder generally includes a cylinder having an edge protruding outwardly from a circumference of the top of the heat sink and a supporting board extending horizontally and inwardly from a top of the cylinder. The fan is fixed on the supporting board.

It is difficult to keep a smoothness of an outer circumferential surface of the heat dissipation device since the edge of the fan holder protrudes outwardly from the circumference of the top of the heat sink, whereby a compact and tidy design is not attainable.

What is needed, therefore, is a heat dissipation device with a fan holder which can overcome the described limitations, and an LED lamp using the same.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the various views.

DETAILED DESCRIPTION

Figure 1:
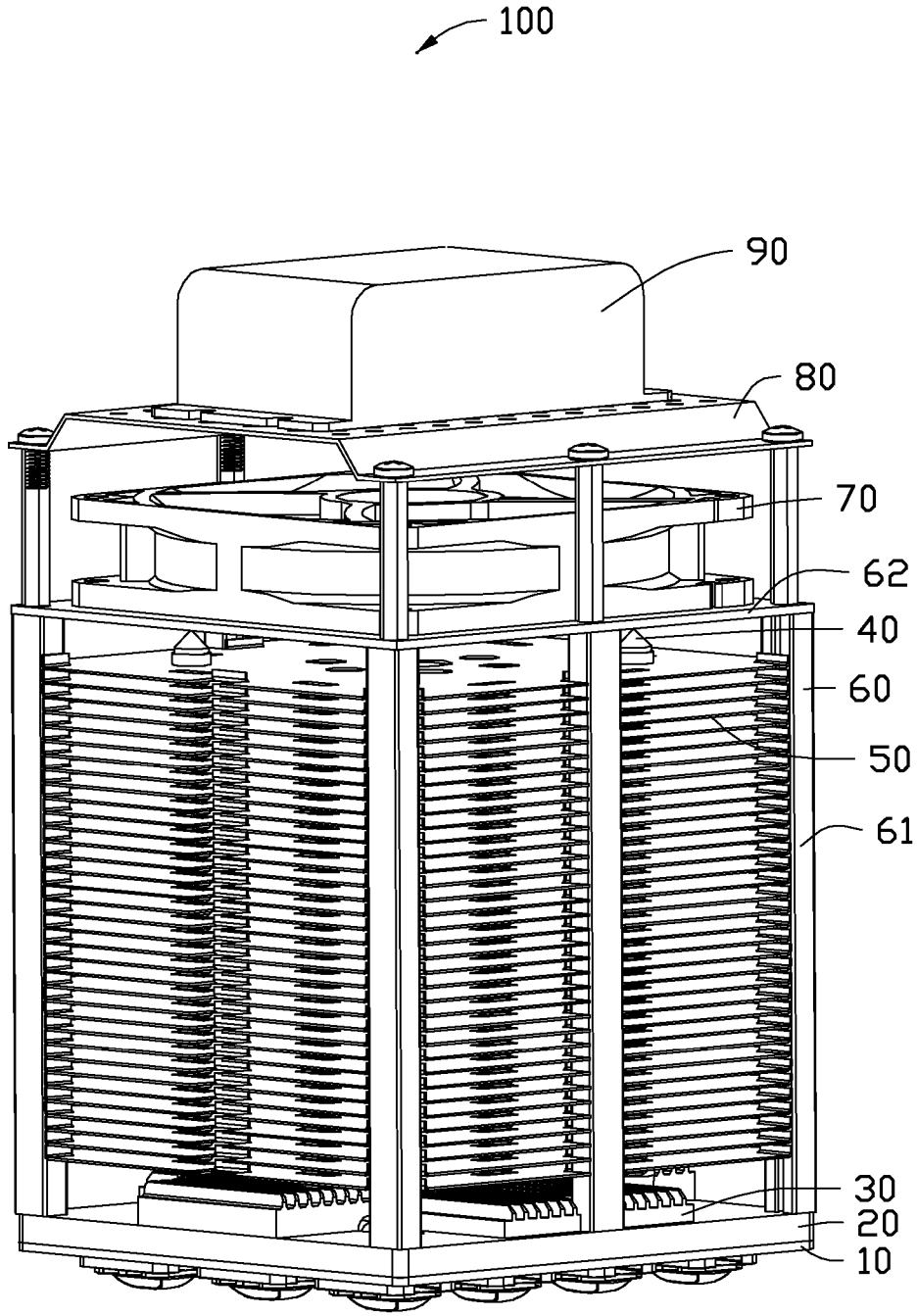
FIG. 1 is an isometric, assembled view of an LED lamp in accordance with a first embodiment of the disclosure.
Figure 2:
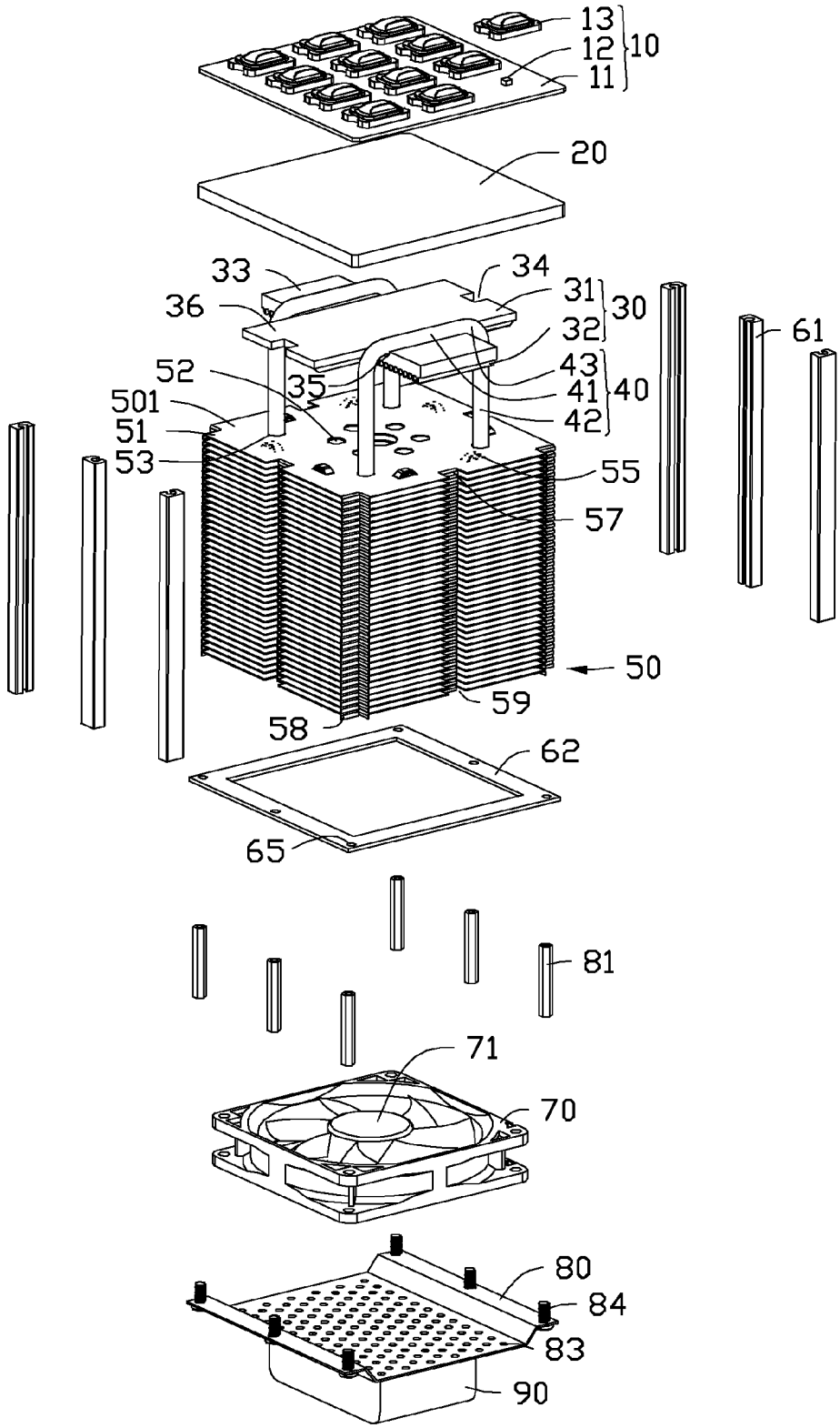
FIG. 2 is an inverted, exploded view of the LED lamp of FIG. 1.

Referring to FIGS. 1-2, an LED lamp 100 in accordance with a first embodiment of the disclosure is illustrated. The LED lamp 100 comprises a light source 10 and a heat dissipation device (not labeled) dissipating heat generated by the light source 10. The heat dissipation device comprises a heat absorption board 20 absorbing the heat generated by the light source 10, a heat sink 30 attached to the heat absorption board 20, a fin assembly 50 located over the heat absorption board 20, two heat pipes 40 thermally connecting the heat absorption board 20 and the fin assembly 50, a fan 70 located over the fin assembly 50, a fan holder 60 fixing the fan 70 on the fin assembly 50, a fan guard 80 positioned over the fan 70 to protect the fan 70 from contamination and damage during operation, and a driving module 90 positioned on the fan guard 80. The heat sink 30 is located between the heat absorption board 20 and the fin assembly 50, and contacts the heat pipes 40.

The light source 10 comprises a planar substrate 11, a plurality of LEDs 12 evenly attached to the substrate 11, and a plurality of lenses 13. The lenses 13 have one-to-one corresponding relationships with respect to the LEDs 12 and cover corresponding LEDs 12. The LEDs 12 bestrew the whole substrate 11.

Figure 3:
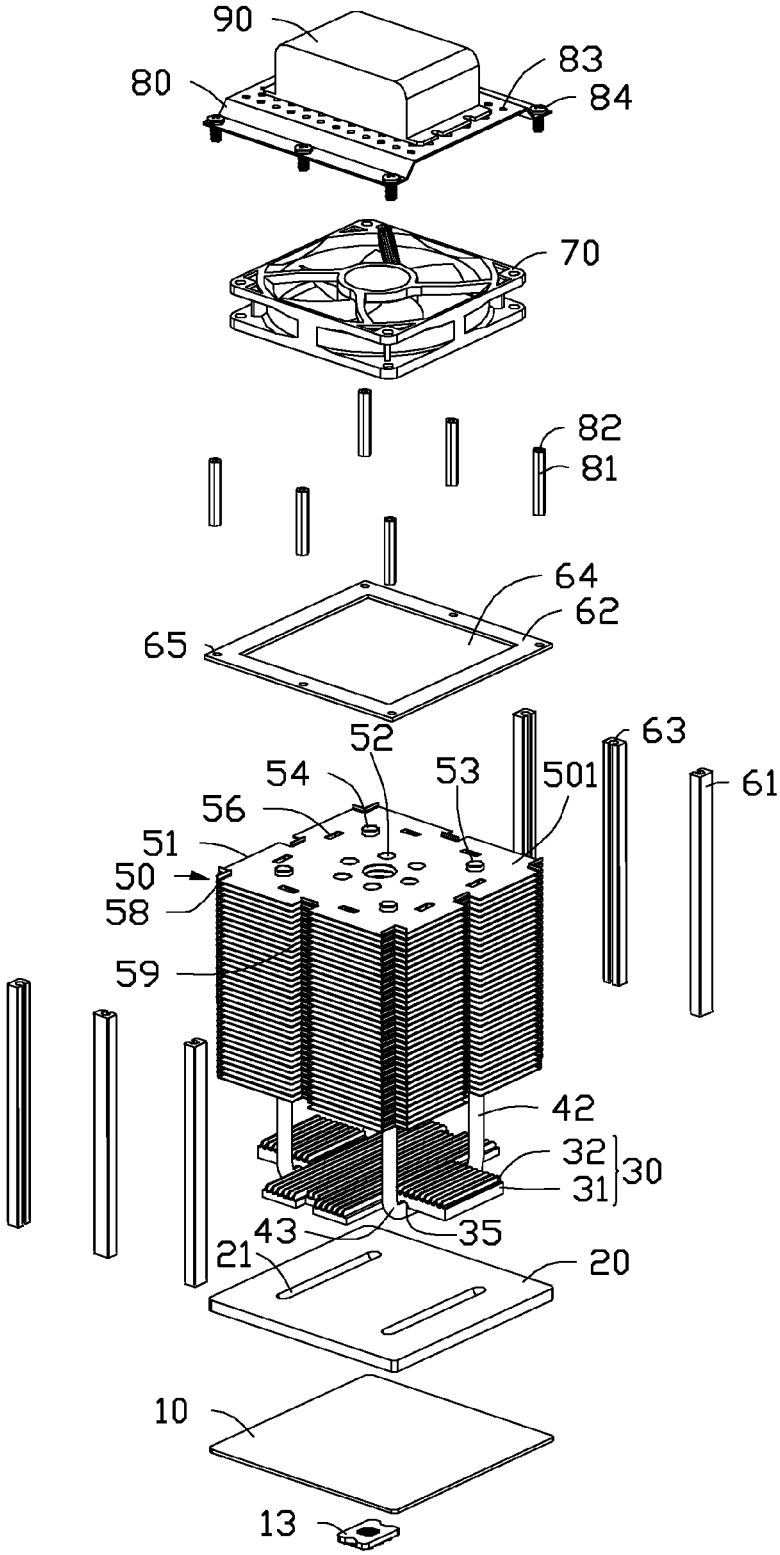
FIG. 3 is an exploded view of the LED lamp of FIG. 1.

The heat absorption board 20 is made of a metal or alloy with a high heat conductivity coefficient, such as copper, copper alloy, or other suitable material. The heat absorption board 20 has a planar configuration. The substrate 11 of the light source 10 is attached to the heat absorption board 20. A top surface area of the substrate 11 is identical to a bottom surface area of the heat absorption board 20, whereby the heat absorption board 20 absorbs heat generated by every LED 12. An outer circumferential surface of the substrate 11 is coplanar with an outer circumferential surface of the heat absorption board 20. Referring also to FIG. 3, two parallel slots 21 are defined in a top surface of the heat absorption board 20. Each of the slots 21 has a semicircular section.

The heat sink 30 is made of a metal or alloy having a good thermal conductivity, such as copper, aluminum or an alloy thereof. In this embodiment, the heat sink 30 is integrally formed by aluminum extrusion. In other embodiments, the heat sink 30 may be formed by stacked fins.

The heat sink 30 comprises a base 31 having a flat bottom surface and a plurality of fins 32 extending upwardly from the base 31. The flat bottom surface of the base 31 thermally contacts the top surface of the heat absorption board 20.

The base 31 comprises a pair of first heat dissipating branches 33 and a pair of second heat dissipating branches 36. The first, second heat dissipating branches 33, 36 extend outwardly from a central portion of the base 31 and are alternate with each other. The first, second heat dissipating branches 33, 36 extend outwardly to align with the outer circumferential surface of the heat absorption board 20, thereby increasing a contact area between the heat sink 30 and the heat absorption board 20. The first heat dissipating branches 33 are perpendicular to the second heat dissipating branches 36. The pair of second heat dissipating branches 36 define two gaps 34 in two opposite ends thereof. The second heat dissipating branches 36 are located between the heat pipes 40. Each of the first heat dissipating branches 33 defines a groove 35 in a bottom surface thereof. The grooves 35 and the slots 21 of the heat absorption board 20 cooperatively define two receiving channels (not labeled).

Each of the heat pipes 40 is U-shaped. The two heat pipes 40 are parallel to and spaced from each other. Each heat pipe 40 comprises a horizontal evaporator section 41, two vertical condenser sections 42 extending upwardly from two opposite ends of the evaporator section 41, and two connecting sections 43 connecting the evaporator section 41 and the condenser sections 42. The evaporator sections 41 are received in the receiving channels cooperatively formed by the grooves 35 of the first heat dissipating branches 33 and the slots 21 of the heat absorption board 20. Each of the first heat dissipating branches 33 is located between two condenser sections 42 of a corresponding heat pipe 40. The condenser sections 42 extend upwardly through the fin assembly 50.

Figure 4:
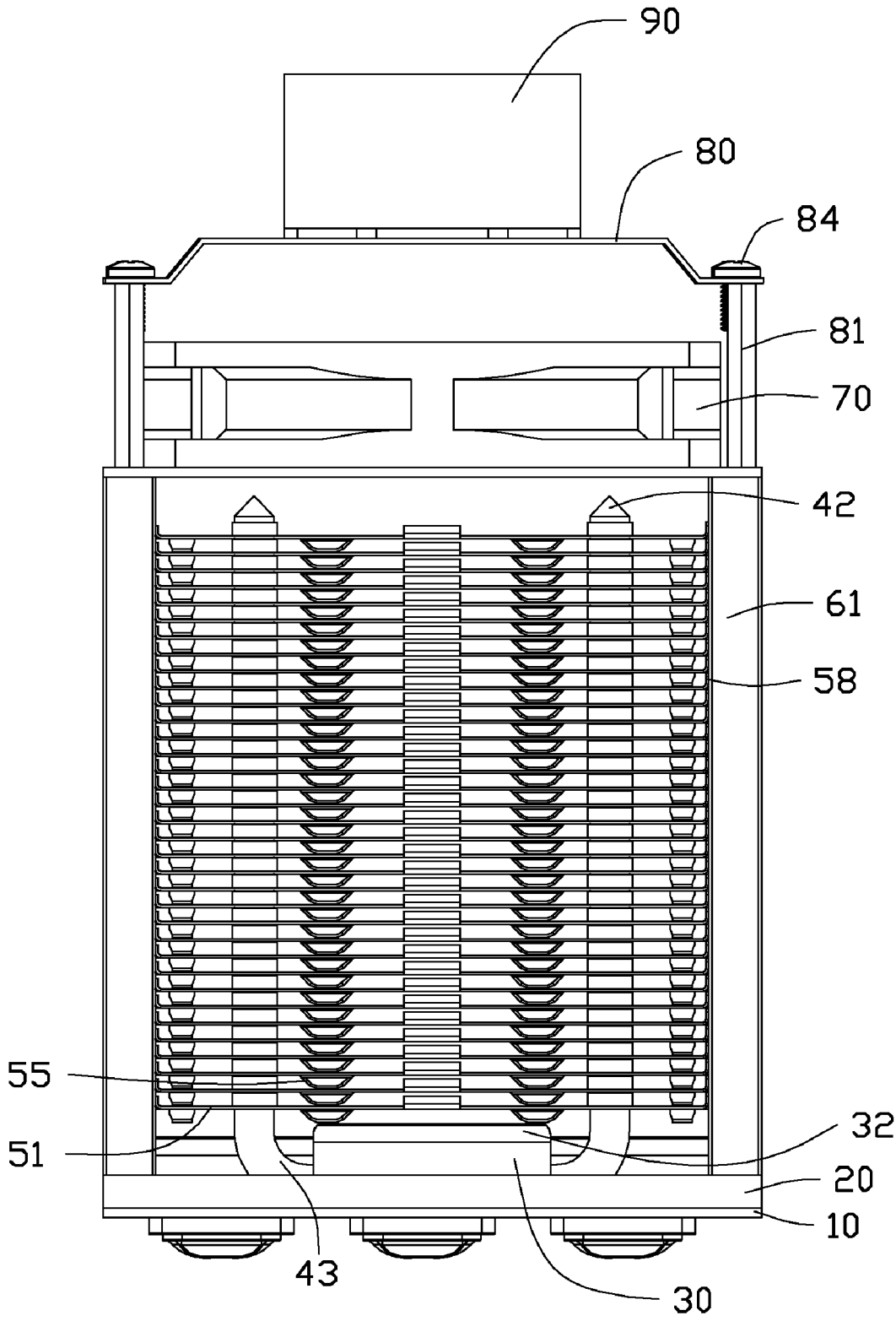
FIG. 4 is a front plan view of the LED lamp of FIG. 1.

Referring also to FIG. 4, a height of the heat sink 30 with respect to the top surface of the heat absorption board 20 is slightly larger than a height of each connecting section 43 with respect to the top surface of the heat absorption board 20, whereby the heat sink 30 makes a full use of a space defined by the connecting sections 43 of the heat pipes 40 over the top surface of the heat absorption board 20.

The fin assembly 50 comprises a plurality of vertically stacked fins 501. Each of the fins 501 comprises a main body 51. The main body 51 is rectangular, and defines a plurality of first through holes 52 for ventilating and a plurality of second through holes 53 therein. The first through holes 52 are located in a central portion of the main body 51. The second through holes 53 are located around the first through holes 52. A plurality of flanges 54 extend upwardly from the main body 51. Each flange 54 is located around a corresponding one of the second through holes 53. The second through holes 53 receive the condenser sections 42 of the heat pipes 40 therein, and the flanges 54 are engaged with the condenser sections 42.

The main body 51 of each fin 501 defines a plurality of punched ventilating holes 56 in an outer edge portion thereof. The punched ventilating holes 56 are evenly arranged in the outer edge portion of the main body 51. Corresponding to the ventilating holes 56, bending sheets 55 are disposed below the main body 51.

Each fin 501 defines a plurality of cutouts 57 in an outer edge thereof. The cutouts 57 are evenly arranged in the outer edge of the fin 501. Bending boards 58 are bent upwardly from the main body 51 of each fin 501 corresponding to the cutouts 57. The bending boards 58 of each fin 501 abut folding portions between the bending boards 58 and the main body 51 of the upper adjacent fin 501, thereby providing an interval between the two adjacent fins 501. When the fins 501 are stacked together, the bending boards 58 of the fins 501 corresponding to the same cutout 57 are stacked together, thereby defining a receiving space 59. The receiving spaces 59 face to an outside of the fin assembly 50.

The fan holder 60 comprises a supporting board 62 located over a top of the fin assembly 50 and a plurality of supporting posts 61 mounted on an outer edge of the heat absorption board 20 and supporting the supporting board 62. Each of the supporting posts 61 has a rectangular cross section. Each supporting post 61 defines an extending groove 63 along a length direction thereof. The extending groove 63 extends through a lateral side of the supporting post 61 to communicate with ambient air. The supporting posts 61 are received into the receiving spaces 59 of the fin assembly 50; that is, the supporting posts 61 are embedded in the receiving spaces 59 of the fin assembly 50. Outer side surfaces of the supporting posts 61 exposed out of the receiving spaces 59 are coplanar with lateral surfaces of the fin assembly 50. The supporting board 62 has outer side surfaces thereof coplanar with the lateral surfaces of the fin assembly 50.

The supporting board 62 has a rectangular configuration. The supporting board 62 defines a window 64 in a central portion thereof, by which the airflow generated by the fan 70 can flow through the supporting board 62. The fan 70 is mounted on an inner edge of the supporting board 62. The supporting board 62 defines a plurality of joining holes 65 in an outer edge thereof. The joining holes 65 correspond to the supporting posts 61.

The fan guard 80 is positioned over the fan 70 via a plurality of threaded poles 81. Each threaded pole 81 defines a threaded hole 82 at an end thereof and along a length direction thereof. The threaded poles 81 extend through the joining holes 65 to be engaged into the extending grooves 63 of the supporting posts 61. A plurality of screws 84 extend through an outer edge of the fan guard 80 to be screwed into the threaded holes 82 of the threaded poles 81, whereby the fan guard 80 is mounted over the fan 70. The fan guard 80 defines a plurality of meshes 83 therein for ventilating.

The driving module 90 is mounted at a central portion of the fan guard 80. The driving module 90 provides a driving voltage for the light source 10 and the fan 70. The driving module 90 is located corresponding to a hub 71 of the fan 70. The airflow generated by the fan 70 flows through the fan guard 80 to dissipate heat generated by the driving module 90.

In assembly of the LED lamp 100, the light source 10 is attached to the top surface of the heat absorption board 20. The heat sink 30 is attached to the bottom surface of the heat absorption board 20. The condenser sections 42 of the heat pipes 40 are sandwiched between the heat sink 30 and the heat absorption board 20. A plurality of fasteners (not shown) extend upwardly through the substrate 11 of the light source 10 and the heat absorption board 20, and are screwed into the extending grooves 63 of the supporting posts 61, whereby the supporting posts 61 are secured to the outer edge of the heat absorption board 20, wherein two of the supporting posts 61 have bottom ends thereof received in the gaps 34 of the second heat dissipating branches 36. The supporting board 62 is secured to tops of the supporting posts 61 via the threaded poles 81. The screws 84 secure the fan guard 80 to tops of the threaded poles 81.

When the LEDs 12 work, heat generated by the LEDs 12 is evenly absorbed by the heat absorption board 20. The evaporator sections 41 of the heat pipes 40 absorb a part of heat from the heat absorption board 20, and transfer the part of heat to the fin assembly 50. The fin assembly 50 dissipates the part of heat to ambient air. At the same time, the heat sink 30 absorbs the other part of heat from the heat absorption board 20, and dissipates the other part of heat to ambient air.

Figure 5:
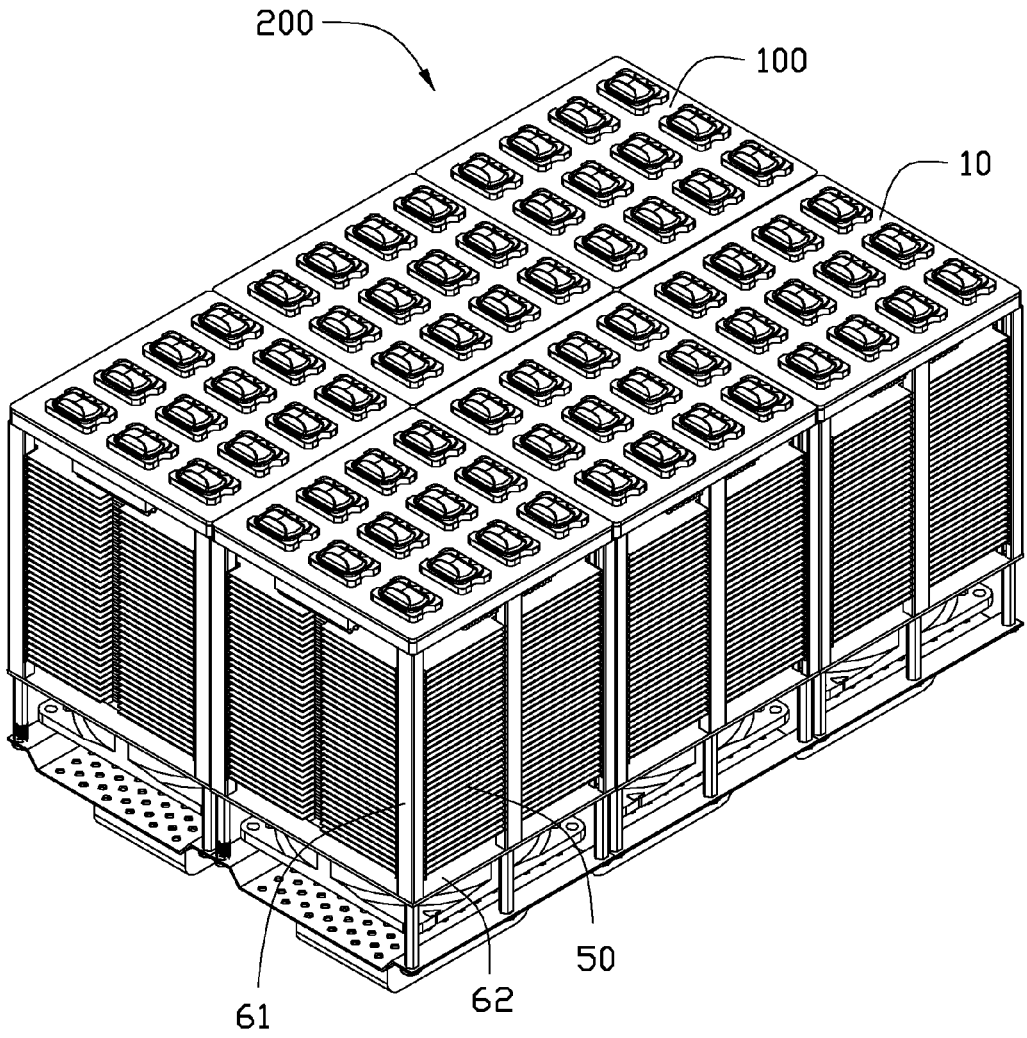
FIG. 5 is an isometric, assembled view of an LED lamp in accordance with a second embodiment of the disclosure, viewed from a bottom aspect.

Referring also to FIG. 5, an LED lamp 200 in accordance with a second embodiment of the disclosure is illustrated. The LED lamp 200 comprises a plurality of the LED lamps 100. The LED lamps 100 are arranged together in such a manner that outer side surfaces of the LED lamps 100 are in tight contact with each other. Specifically, the heat dissipation devices of two adjacent LED lamps 100 are in tight contact with each other in such a manner that lateral surfaces of the fin assemblies 50 of the heat dissipation devices are in tight contact with each other.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation device comprising:

a heat absorption board adapted for contacting a light source to absorb heat therefrom;

a fin assembly located over the heat absorption board;

a heat sink located between the heat absorption board and the fin assembly;

two heat pipes thermally connecting the heat absorption board and the fin assembly;

a fan; and a fan holder fixing the fan on the fin assembly, the fan holder comprising a supporting board supporting the fan and a plurality of supporting posts connecting an outer edge of the heat absorption board and an outer edge of the supporting board, the supporting posts being embedded in the fin assembly;

wherein each of the heat pipes comprises an evaporator section and two condenser sections extending from two opposite ends of the evaporator section, the evaporator sections of the heat pipes contacting the heat absorption board, the condenser sections extending through the fin assembly; and wherein the heat sink comprises a pair of first heat dissipating branches and a pair of second heat dissipating branches, the first heat dissipating branches and the second heat dissipating branches being alternate with each other, the first heat dissipating branches contacting the evaporator sections of the heat pipes, the second heat dissipating branches being located between the heat pipes.

2. The heat dissipation device of claim 1, wherein outer side surfaces of the supporting posts exposed out of the fin assembly are coplanar with lateral surfaces of the fin assembly.

3. The heat dissipation device of claim 1, wherein the first heat dissipating branches and the second heat dissipating branches extend outwardly to an outer circumferential surface of the heat absorption board, thereby increasing a contact area between the heat sink and the heat absorption board.

4. The heat dissipation device of claim 1 further comprising a fan guard positioned over the fan and a driving module mounted on the fan guard, wherein the fan guard defines a plurality of meshes therein, the driving module corresponding to a hub of the fan.

5. The heat dissipation device of claim 4 further comprising a plurality of threaded poles, wherein the threaded poles connect the outer edge of the supporting board and an outer edge of the fan guard to support the fan guard, the fan being surrounded by the threaded poles.

6. An LED lamp comprising:

a light source comprising a plurality of LEDs; and a heat dissipation device comprising a heat absorption board contacting the light source for absorbing heat generated by the LEDs, a fin assembly located over the heat absorption board, a heat sink located between the heat absorption board and the fin assembly, two heat pipes thermally connecting the heat absorption board and the fin assembly, a fan and a fan holder fixing the fan on the fin assembly;

wherein the fan holder comprises a supporting board supporting the fan and a plurality of supporting posts connecting an outer edge of the heat dissipation board and an outer edge of the supporting board, the supporting posts being embedded in the fin assembly;

wherein each of the heat pipes comprises an evaporator section and two condenser sections extending from two opposite ends of the evaporator section thereof, the evaporator sections of the heat pipes contacting the heat absorption board, the condenser sections extending through the fin assembly; and wherein the heat sink comprises a pair of first heat dissipating branches and a pair of second heat dissipating branches, the first heat dissipating branches and the second heat dissipating branches being alternate with each other, the first heat dissipating branches contacting the evaporator sections of the heat pipes, the second heat dissipating branches being located between the heat pipes.

7. The LED lamp of claim 6, wherein outer side surfaces of the supporting posts exposed out of the fin assembly are coplanar with lateral surfaces of the fin assembly.

8. The LED lamp of claim 6, wherein the first heat dissipating branches and the second heat dissipating branches extend outwardly to align with an outer circumferential surface of the heat absorption board, thereby increasing a contact area between the heat sink and the heat absorption board.

9. The LED lamp of claim 6 further comprising a fan guard positioned over the fan via a plurality of threaded poles, wherein the threaded poles connect the outer edge of the supporting board and an outer edge of the fan guard to support the fan guard.

10. The LED lamp of claim 6, wherein the fin assembly comprises a plurality of fins, each of the fins defining a plurality of cutouts evenly arranged in an outer edge thereof to receive the supporting posts.

11. An LED lamp comprising:

a plurality of light sources each comprising a plurality of LEDs; and a plurality of heat dissipation devices each comprising a heat absorption board contacting the light source to absorb heat generated by the LEDs, a fin assembly located over the heat absorption board, a heat sink located between the heat absorption board and the fin assembly, two heat pipes thermally connecting the heat absorption board and the fin assembly, a fan and a fan holder fixing the fan on the fin assembly;

wherein the fan holder of each of the heat dissipation device comprises a supporting board supporting the fan and a plurality of supporting posts connecting an outer edge of the heat dissipation board and an outer edge of the supporting board, the supporting posts being embedded in the fin assembly, two adjacent heat dissipation devices being in tight contact with each other in such a manner that outer side surfaces of the fin assemblies of the adjacent heat dissipation devices are in tight contact with each other;

wherein each of the heat pipes comprises an evaporator section and two condenser sections extending from two opposite ends of the evaporator section thereof, the evaporator sections of the heat pipes contacting the heat absorption board, the condenser sections extending through the fin assembly; and wherein the heat sink comprises a pair of first heat dissipating branches and a pair of second heat dissipating branches, the first heat dissipating branches and the second heat dissipating branches being alternate with each other, the first heat dissipating branches contacting the evaporator sections of the heat pipes, the second heat dissipating branches being located between the heat pipes.

12. The LED lamp of claim 11, wherein outer side surfaces of the supporting posts exposed out of the fin assembly are coplanar with lateral surfaces of the fin assembly.

* * * * *